US010825280B2

(12) United States Patent
Andre

(10) Patent No.: US 10,825,280 B2
(45) Date of Patent: Nov. 3, 2020

(54) SYSTEM FOR CONVERTING A MOBILE ELECTRONIC PAYMENT TERMINAL INTO A FIXED ELECTRONIC PAYMENT TERMINAL

(71) Applicant: INGENICO GROUP, Paris (FR)

(72) Inventor: Jerome Andre, Montoison (FR)

(73) Assignee: INGENICO GROUP, Paris (FR)

( * ) Notice: Subject to any disclaimer, the term of this patent is extended or adjusted under 35 U.S.C. 154(b) by 0 days.

(21) Appl. No.: 16/339,960

(22) PCT Filed: Jul. 21, 2017

(86) PCT No.: PCT/EP2017/068445
§ 371 (c)(1),
(2) Date: Apr. 5, 2019

(87) PCT Pub. No.: WO2018/065133
PCT Pub. Date: Apr. 12, 2018

(65) Prior Publication Data

US 2019/0287333 A1 Sep. 19, 2019

(30) Foreign Application Priority Data

Oct. 7, 2016 (FR) ..... 16 59674

(51) Int. Cl.
*G07F 7/08* (2006.01)
*G07F 7/00* (2006.01)
*G07G 1/00* (2006.01)

(52) U.S. Cl.
CPC ..... *G07F 7/0873* (2013.01); *G07F 7/005* (2013.01); *G07F 7/0886* (2013.01); *G07G 1/0018* (2013.01)

(58) Field of Classification Search
CPC ..... G06K 7/00; G06K 7/0004; G07F 7/0873; G07F 7/088; G07F 7/0886; G07F 7/005; G07F 7/08; G07G 1/0018; G06Q 20/322
See application file for complete search history.

(56) References Cited

U.S. PATENT DOCUMENTS 5,289,923 A 3/1994 Coblentz et al.
9,619,975 B2 4/2017 Bonnet et al.
(Continued)

FOREIGN PATENT DOCUMENTS

CA 2635745 A1 12/2009
EP 3016079 A1 5/2016
WO 2016059201 A1 4/2016

OTHER PUBLICATIONS

International Search Report and Written Opinion dated Aug. 8, 2017 for corresponding International Application No. PCT/EP2017/068445, filed Jul. 21, 2017.
(Continued)

*Primary Examiner* — Thien M Le
*Assistant Examiner* — April A Taylor
(74) *Attorney, Agent, or Firm* — David D. Brush; Westman, Champlin & Koehler, P.A.

(57) ABSTRACT

A system of conversion of a mobile electronic payment terminal into a fixed electronic payment terminal. The system includes: first and second support elements having first hooking elements and a first reversible locking element. The support elements are configured to receive the electronic payment terminal or a charging base for charging the electronic payment terminal and to be fixedly attached to the charging base or to a fixed pedestal. The system also includes a lower hatch to be fixed beneath the electronic payment terminal and having second hooking elements configured to cooperate with the first hooking elements of the first and second support elements, and further having a
(Continued)

Figure 1A:
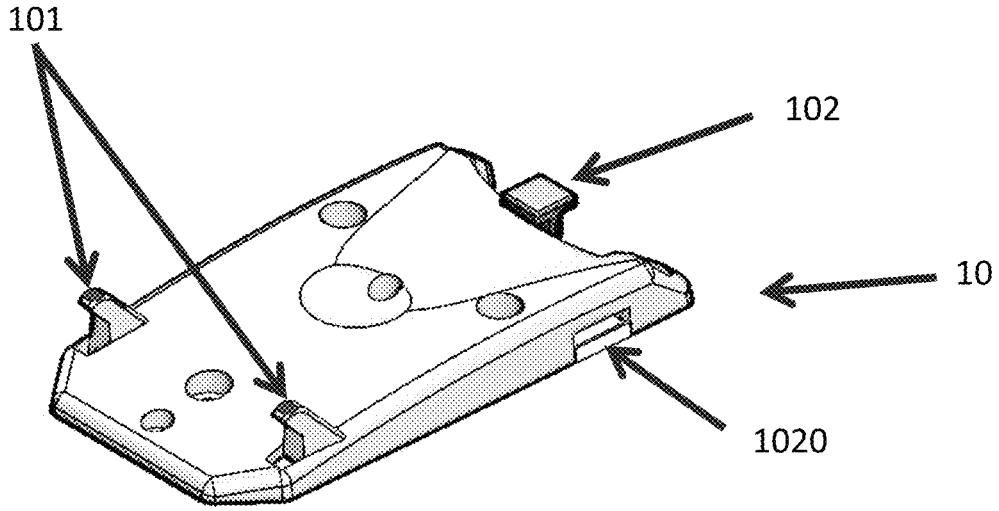

second reversible locking element configured to cooperate the first the reversible locking element the support elements.

7 Claims, 10 Drawing Sheets

(56) References Cited

U.S. PATENT DOCUMENTS

| | | | | |
|---|---|---|---|---|
| 9,648,156 | B2 * | 5/2017 | Froment | G06F 13/4081 |
| 2005/0236480 | A1 * | 10/2005 | Vrotsos | G06Q 20/341 235/439 |
| 2013/0262248 | A1 * | 10/2013 | Kim | G06F 1/1632 705/17 |
| 2016/0253668 | A1 | 9/2016 | Lee | |
| 2017/0046678 | A1 * | 2/2017 | Demir | G06Q 20/105 |
| 2017/0236109 | A1 | 8/2017 | Pignal | |

OTHER PUBLICATIONS

English translation of the International Written Opinion dated Aug. 17, 2017 for corresponding International Application No. PCT/EP2017/068445, filed Jul. 21, 2017.

* cited by examiner

SYSTEM FOR CONVERTING A MOBILE ELECTRONIC PAYMENT TERMINAL INTO A FIXED ELECTRONIC PAYMENT TERMINAL

CROSS-REFERENCE TO RELATED APPLICATIONS

This Application is a Section 371 National Stage Application of International Application No. PCT/EP2017/068445, filed Jul. 21, 2017, which is incorporated by reference in its entirety and published as WO 2018/065133 A1 on Apr. 12, 2018, not in English.

1. FIELD OF THE INVENTION

The invention relates to the field of data entry devices such as payment terminals and, more particularly, to their character of being mobile/portable or fixed.

2. PRIOR ART

At present, for reasons of ergonomy and specificity of uses, there are two types of electronic payment terminals: portable or mobile electronic payment terminals and fixed electronic payment terminals.

Thus, fixed electronic payment terminals are more generally used in businesses such as large shopping centers where it is preferable for the electronic payment terminal to be fixed and locked to a support because of very frequent and sometimes unmonitored use (in automatic cashier desks for example). Mobile electronic payment terminals for their part are preferred in businesses such as restaurants where it is more practical to bring the electronic payment terminal to the customer so that he does not have to move in order to pay his bill.

Thus, the manufacturers of electronic payment terminals have adapted to these new uses and most frequently offer a catalog presenting both fixed electronic payment terminals and mobile electronic payment terminals, where one and the same model (in terms of software and hardware configuration) of electronic payment terminal is most frequently proposed in both versions (portable and fixed). However, this diversity of electronic payment terminals makes both manufacture and maintenance very costly for a manufacturer.

Another drawback related to this diversity lies in the fact that a customer (a merchant for example) must choose whether to purchase a fixed electronic payment terminal or a mobile electronic payment terminal even if he could need both versions and might prefer, for example, in certain situations to use one or more fixed electronic payment terminals and in other situations to use one or more mobile electronic payment terminals.

There is therefore a need for a solution to meet the demand by users of electronic payment terminals, namely merchants, to be able to use one and the same electronic payment terminal in a fixed version and in a mobile version while maintaining the requirements of security to which the electronic payment terminals are subject and minimizing manufacturing and maintenance costs for the manufacturer of electronic payment terminals.

3. SUMMARY

The invention relates to a system for converting a mobile electronic payment terminal into a fixed electronic payment terminal comprising at least the following elements:

- two support elements comprising first hooking means and first reversible locking means, the support elements being configured to receive the electronic payment terminal or a charging base for the electronic payment terminal and to be fixedly attached to the charging base or to a fixed pedestal;
- a lower hatch intended to be fixed beneath the electronic payment terminal and comprising second hooking means configured to cooperate with the first hooking means of a support element, and second reversible locking means configured to cooperate with the first reversible locking means of a support element.

Thus, the invention proposes a novel and inventive solution to the designing of an electronic payment terminal enabling a user, by himself, to convert a mobile electronic payment terminal into a fixed electronic payment terminal in a reversible manner.

To this end, the invention provides a conversion system, also called a conversion kit, formed by several elements making it possible to be able to fix and lock a mobile electronic payment terminal to a pedestal (which is itself fixed) and, at the same time, ensure that the electronic payment terminal can always be placed on its charging base, itself therefore being capable of being fixed and locked to a pedestal.

For example, the conversion kit comprises two support elements and a lower electronic payment terminal hatch.

Thus, to be able to carry out the conversion, the "classic" lower hatch of the mobile electronic payment terminal must be replaced by the hatch provided in the conversion kit. This lower hatch is intended firstly to close the casing of the electronic payment terminal and secondly to enable the charging of the electronic payment terminal when it is placed on a charging base. The modified hatch provided in the conversion kit according to the invention indeed makes it possible to cooperate with either of the two support elements of the conversion kit. For example, the modifications made to this lower hatch consist especially in providing means for hooking the hatch (and therefore the electronic payment terminal) to a support element, as well as providing reversible locking means to ensure a fastening and a locking of the electronic payment terminal to a fixed pedestal or to a charging base via a support element.

The two support elements provided in the conversion kit according to the invention are for example identical and enable the conversion of a mobile electronic payment terminal into a fixed electronic payment terminal, i.e. a terminal that can be affixed and locked to a fixed pedestal via a support element while being capable of being placed on a charging base, again through a support element. In addition, the charging base itself can also be affixed and locked to a fixed pedestal, and this explains the need to provide two support elements in the conversion kit.

A user of a mobile electronic payment terminal can therefore, through this conversion kit alone, convert his mobile electronic payment terminal into a fixed electronic payment terminal while, in to the prior-art solutions, this very same user would have to purchase another version (the fixed version) of the electronic payment terminal (or send his electronic payment terminal back to the manufacturer for exchange or modification by the manufacturer).

It must be noted that the charging base of the electronic payment terminal must also be modified to become compatible with the lower terminal hatch provided in the conversion kit, but this modification can be implemented definitively by the manufacturer itself. Indeed, it is possible to render all charging bases (wired and wireless) compatible with the invention while maintaining compatibility with existing electronic payment terminals. To this end, for example, on a charging base of this kind, elements are provided capable of cooperating with the hooking and locking means of a support element, on the lower part of the base as well as means for receiving a support element on the upper part of the base.

According to one particular aspect, the at least two support elements correspond to:

- a first support element, called a support element for a base, intended, on the one hand, to be fixedly attached to the charging base of the electronic payment terminal and, on the other hand, to receive the electronic payment terminal;
- a second support element, called a support element for pedestal, intended on the one hand to be fixedly attached to the fixed pedestal and, on the other hand, to receive the electronic payment terminal or the charging base of the electronic payment terminal.

Thus, according to this first embodiment of the invention, the two support elements provided in the conversion kit are for example identical and fulfil the following functions:

- for the first support element, called a support element for a base, receiving the electronic payment terminal; the support element for a base is therefore fixed to a charging base of the electronic payment terminal and has means for hooking the terminal as well as means for the reversible locking of the preliminarily hooked terminal;
- for the second support element, called a support element for pedestal, receiving either the charging base of the electronic payment terminal or the electronic payment terminal itself; the support element for pedestal is therefore affixed to a (fixed) pedestal and has means for hooking the base or the terminal, as well as means for the reversible locking of the preliminarily hooked base or terminal.

Thus, a user possessing a mobile electronic payment terminal and a conversion kit according to one of the embodiments of the invention can use his electronic payment terminal:

- in a non-modified mobile version capable of being classically charged on a base (that is modified or not modified to be compatible with the invention);
- in a fixed version, hooked and locked to a support element, itself fixedly attached to a fixed pedestal (for example a shop counter);
- in a fixed version, hooked and locked to a support element, itself hooked and locked to a charging base (modified to be compatible with the invention) itself fixedly attached to a fixed pedestal (for example a shop counter).

For example, the first hooking means of a support element correspond to at least two fixed lateral hooks and the first reversible locking means of the support element correspond to at least one mobile central hook, called a locking hook. In addition, the second means for hooking the hatch correspond to at least two lateral apertures cooperating with the two fixed lateral hooks of the support element and the second reversible locking elements of the hatch correspond to at least one central aperture cooperating with the locking hook of the support element.

Thus, according to this embodiment of the invention, the means for hooking the support elements enable either the modified hatch of the electronic payment terminal or the modified charging base to be maintained on the support element, taking the form of fixed lateral hooks, cooperating with corresponding apertures in the modified hatch or the modified charging base. In this way, when the terminal is placed, via its modified lower hatch, on a support element, the terminal is held in position through the two lateral hooks of the support element inserted into the two lateral apertures of the modified hatch. This is also the case for the modified charging base when it is placed on a support element.

In addition, the locking means of the support elements enabling either the modified hatch of the electronic payment terminal or the modified charging base to be locked to the support element, take the form of at least one mobile central hook cooperating with at least one corresponding aperture in the modified hatch or the modified charging base. This hook is mobile once it is inserted into the corresponding aperture of the modified hatch or the modified charging base so that it can lock and unlock the terminal or the charging base, thus enabling the reversible conversion of the mobile electronic payment terminal into a fixed electronic payment terminal.

According to one particular implementation, the locking hook is accessible only through a tool inserted for example on the side of the support element so as to ensure efficient and secured locking.

According to one particular characteristic, the support elements furthermore have first means of affixation to the charging base and second means of affixation to the fixed pedestal.

Thus, according to this embodiment of the invention, the support elements of the conversion kit can be affixed to a charging base or a pedestal so as to enable the different uses of the electronic payment terminal that has been converted into a fixed electronic payment terminal.

For example, these means of affixation correspond to a set formed by screws and apertures intended for the passage of these screws through the support element, where the apertures may be distinct for affixation to a base or to a pedestal.

In particular, a support element comprises at least one first part to receive the charging base or the hatch of the electronic payment terminal, a second part comprising the first reversible locking means and a third part to be affixed to the fixed pedestal or to the charging base.

Thus, according to this embodiment of the invention, the support elements of the conversion kit are formed by three distinct assembled parts capable for example of being made of different materials in order to comply with certain constraints of manufacture. In addition, the second locking part must be mobile, the first and second parts imprisoning this second part while allowing it to slide for the locking and unlocking actions.

According to one particular characteristic, the hatch comprises a part adapted to the lower surface of the electronic payment terminal and two mobile parts forming means for fixedly attaching the hatch to the electronic payment terminal.

4. FIGURES

Figure 1B:
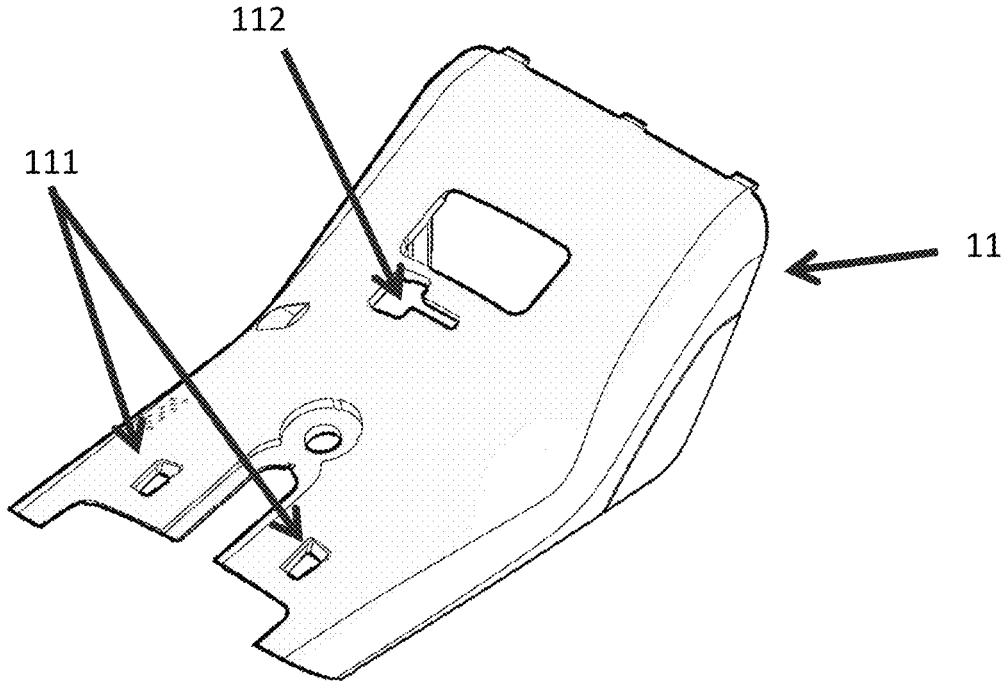
Figure 1C:
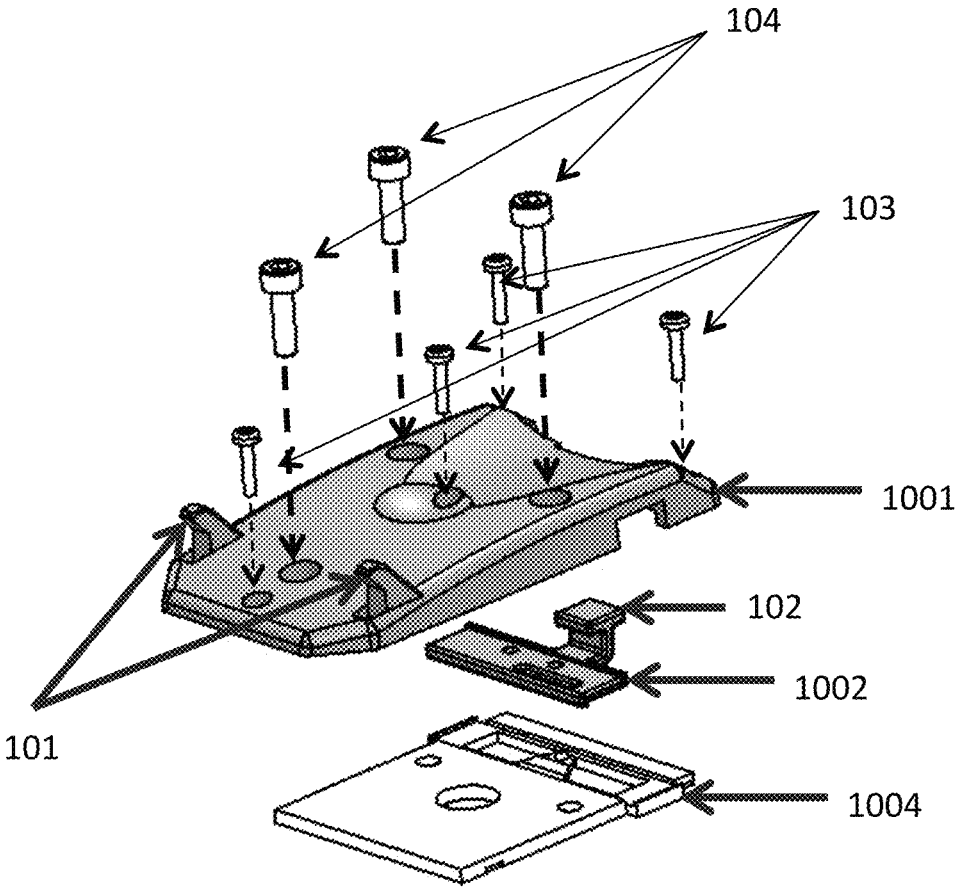
Figure 2A:
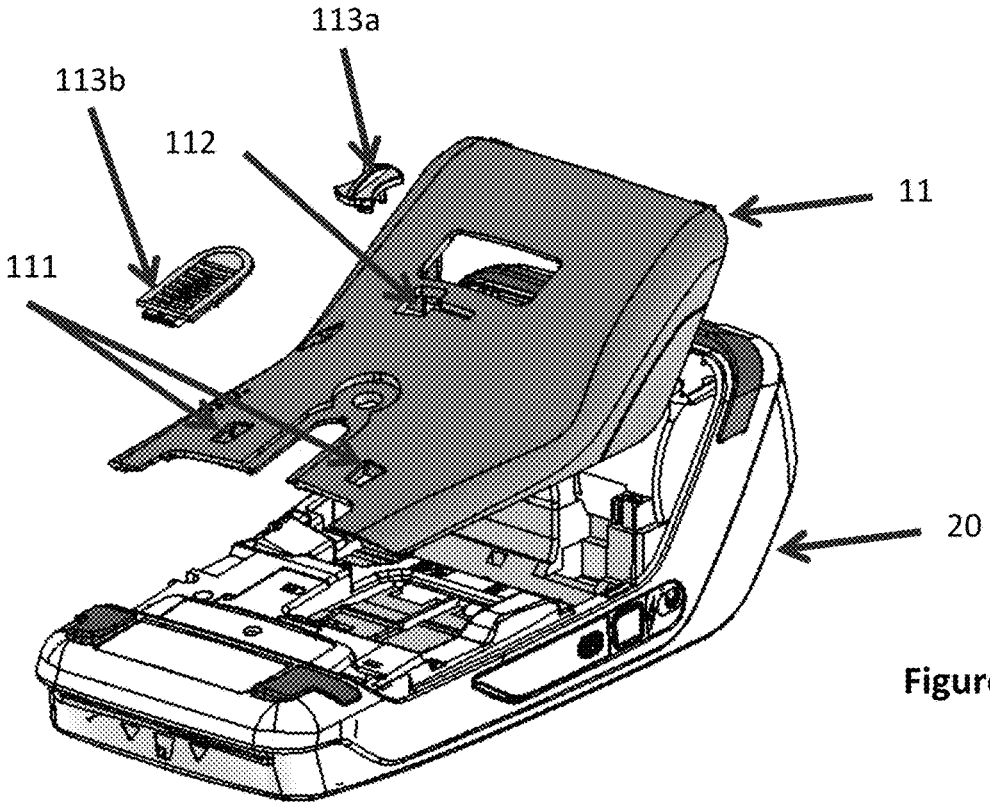
Figure 2B:
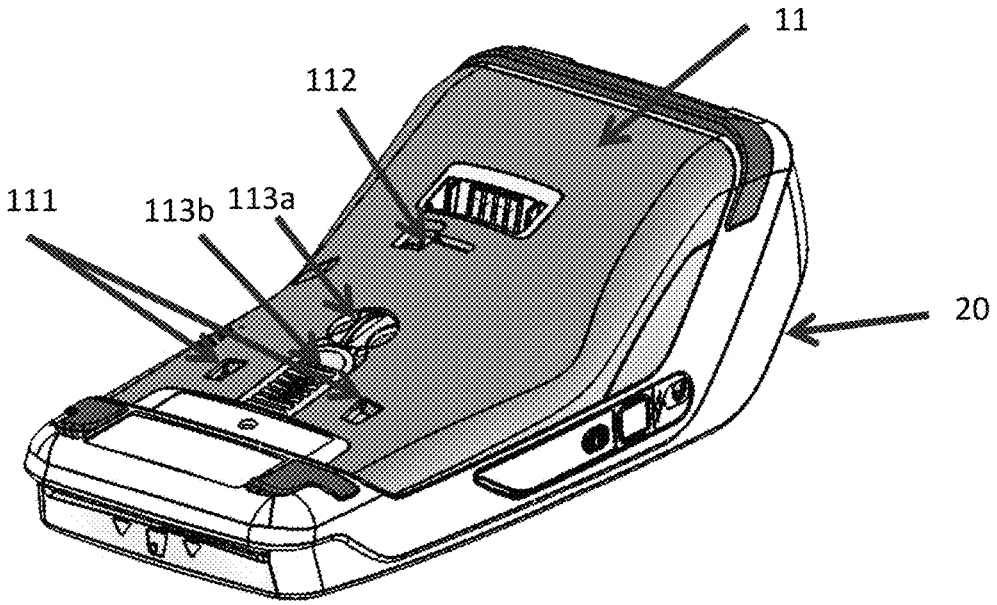
Figure 2C:
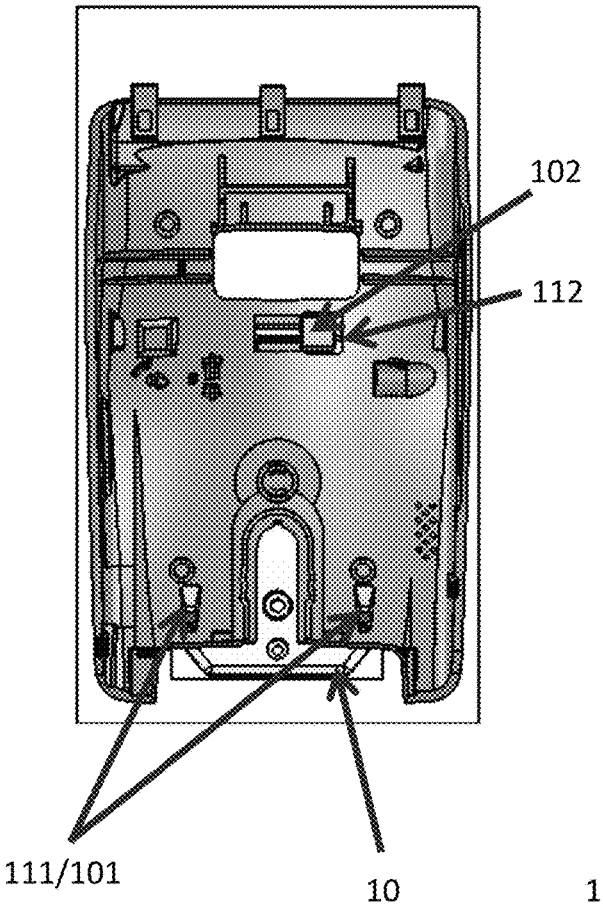
Figure 2D:
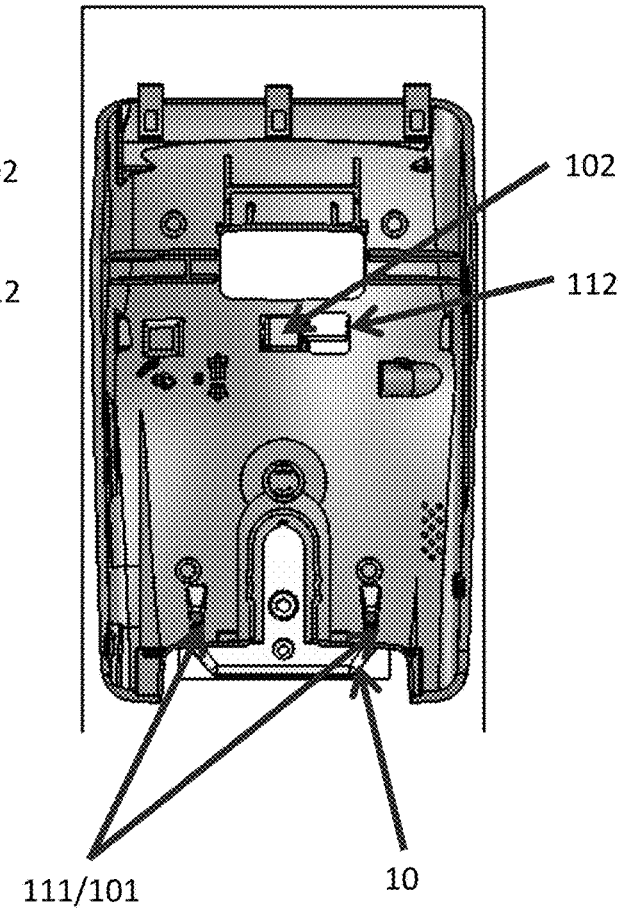
Figure 3A:
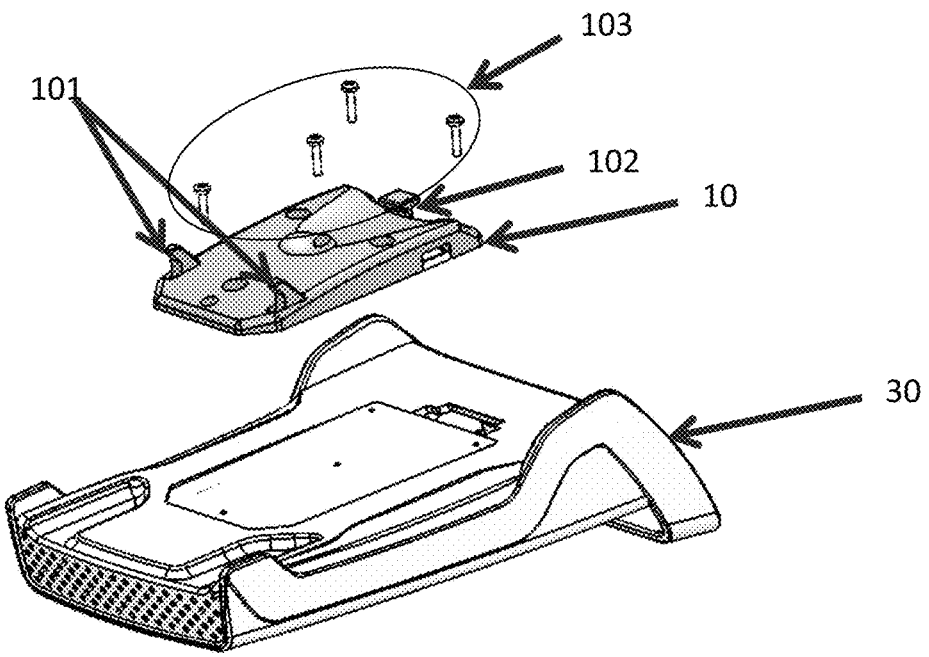
Figure 3B:
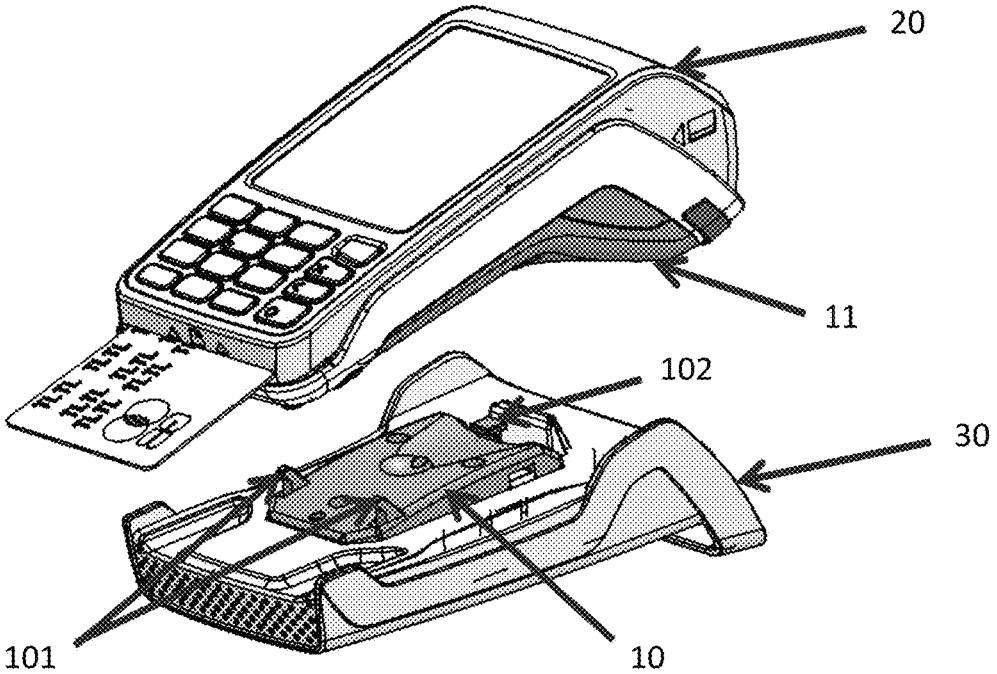
Figure 3C:
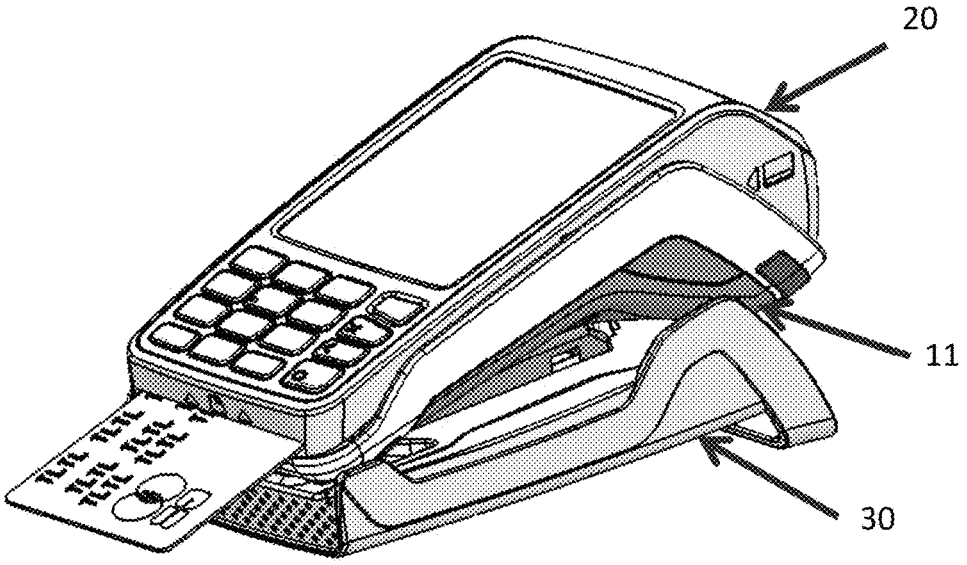
Figure 4A:
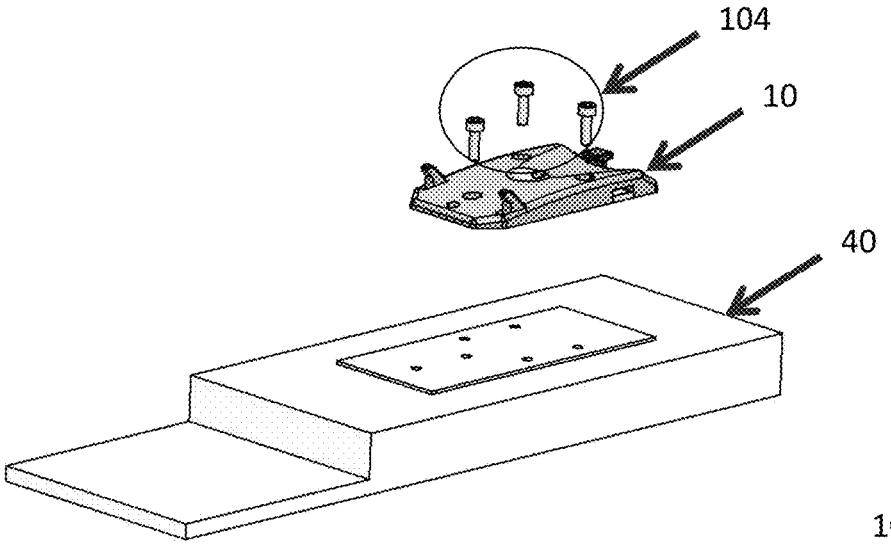
Figure 4B:
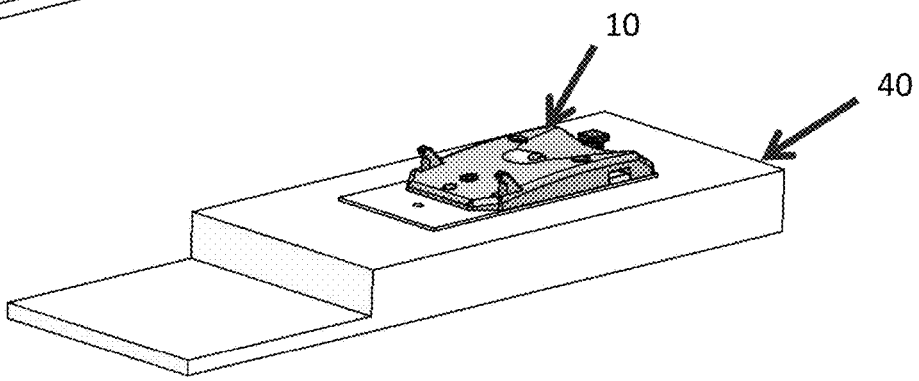
Figure 4C:
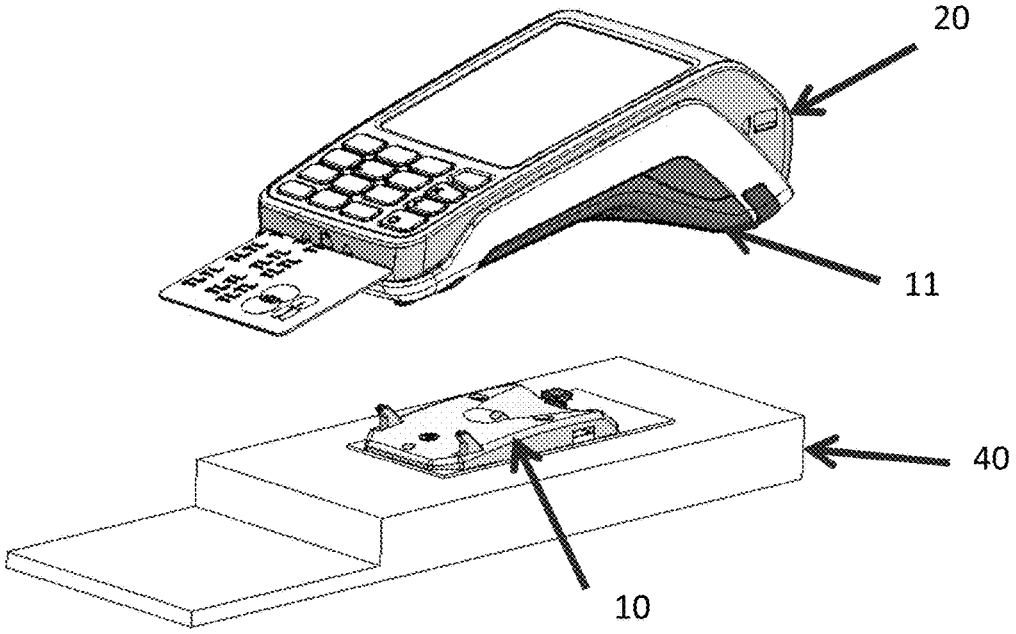
Figure 4D:
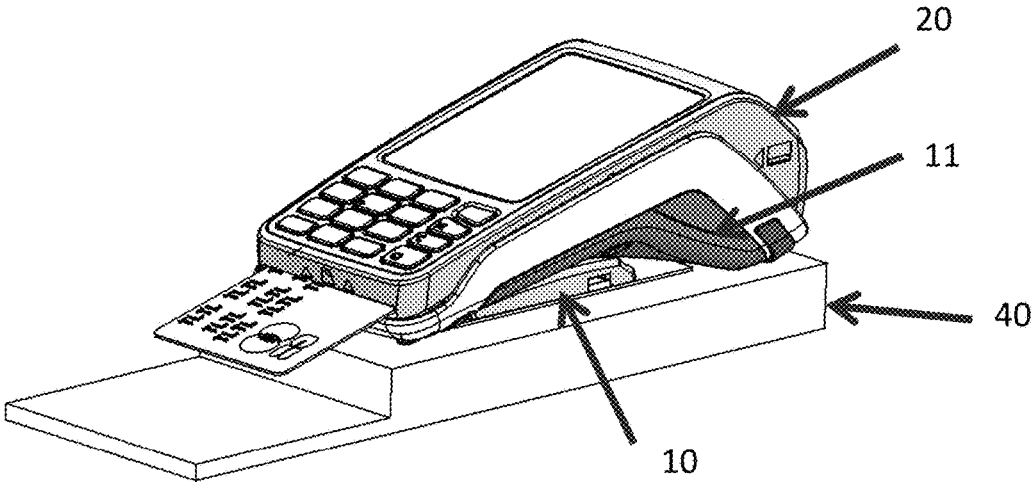
Figure 4E:
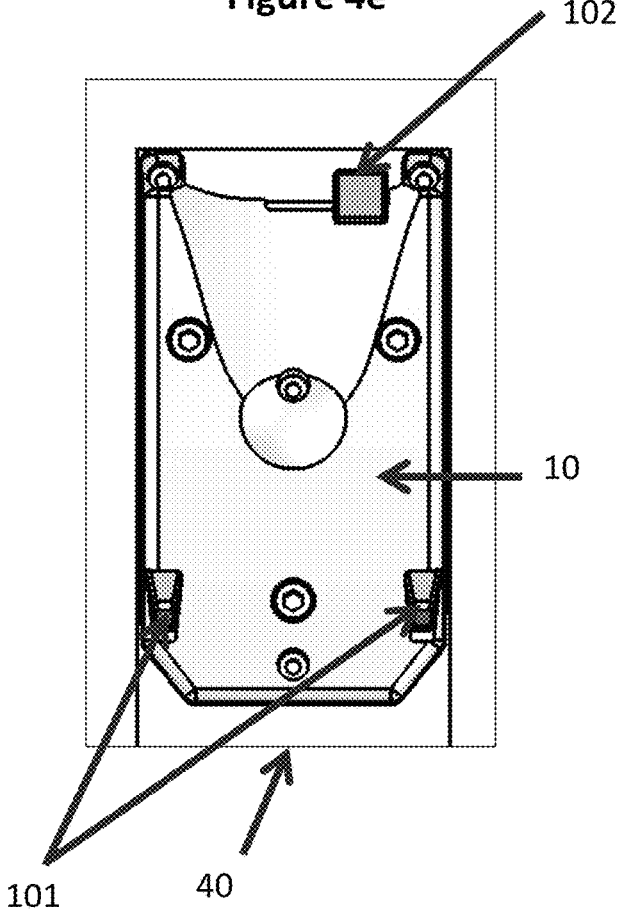
Figure 4F:
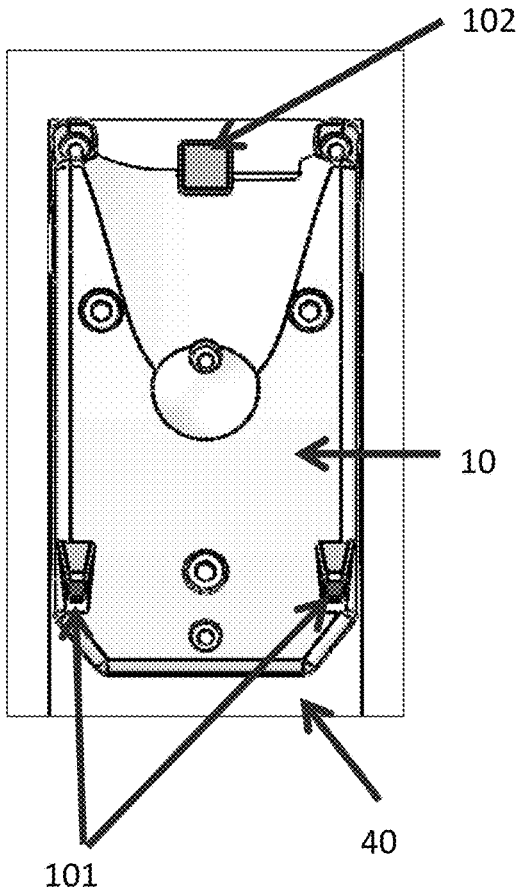
Figure 5A:
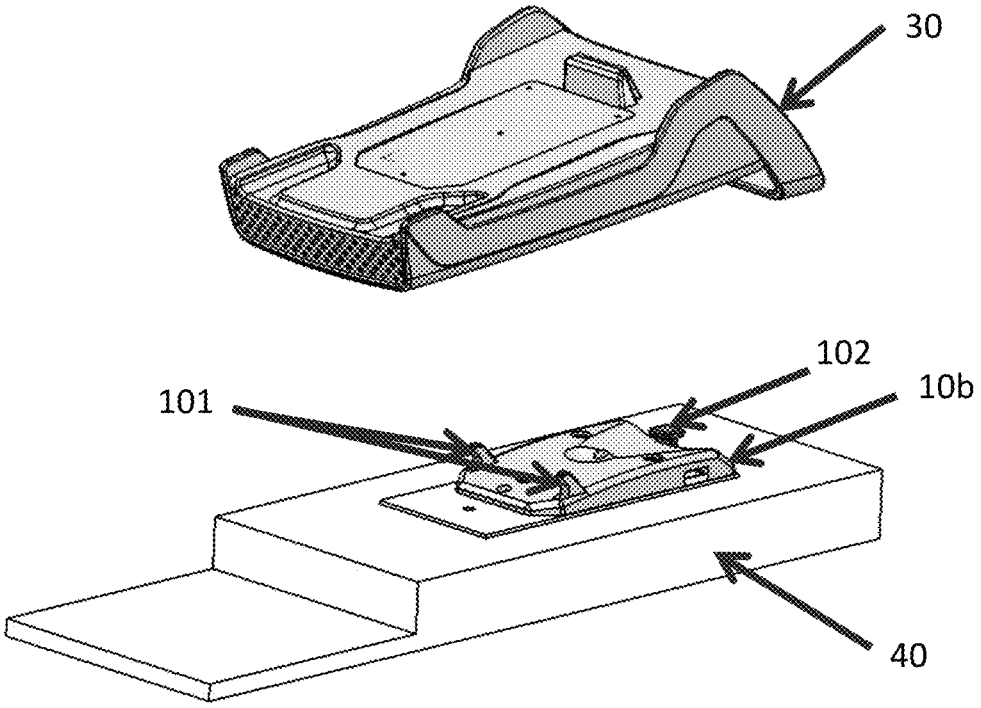
Figure 5B:
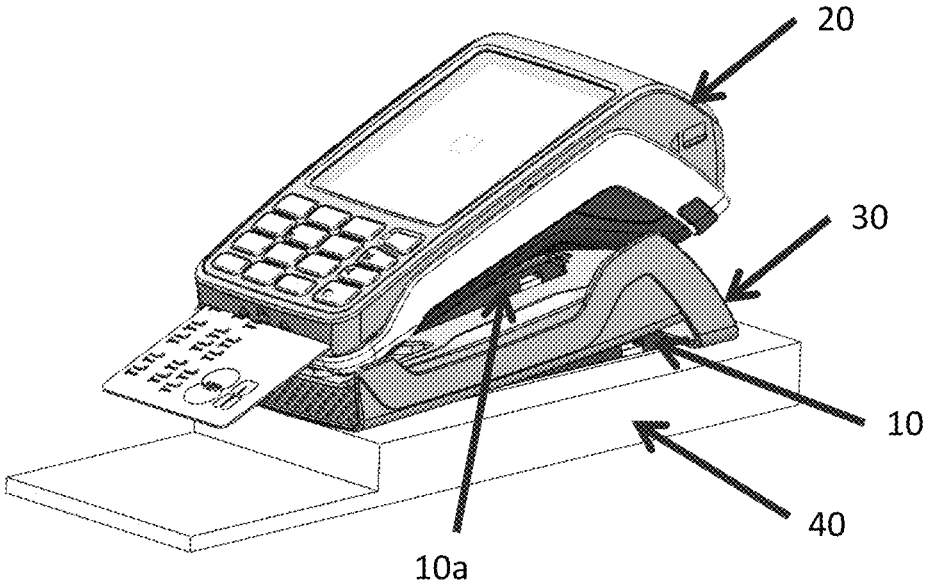
Figure 5C:
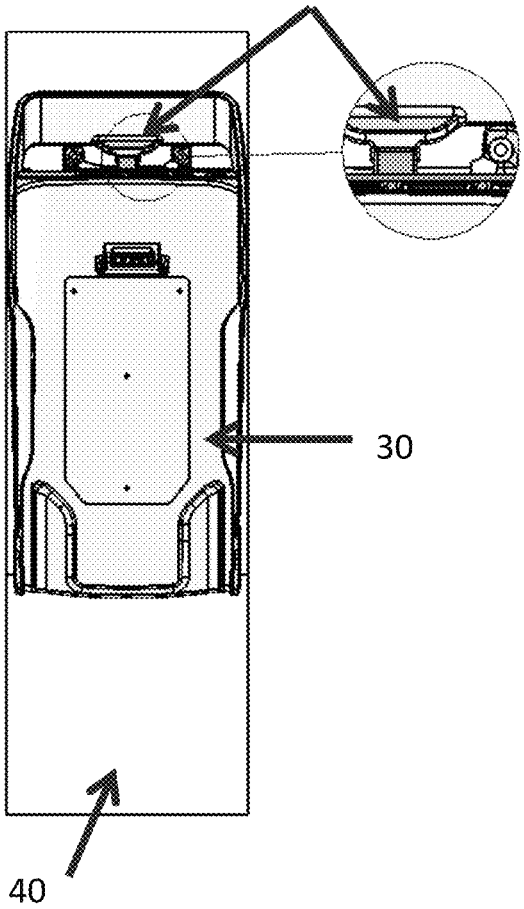
Figure 5D:
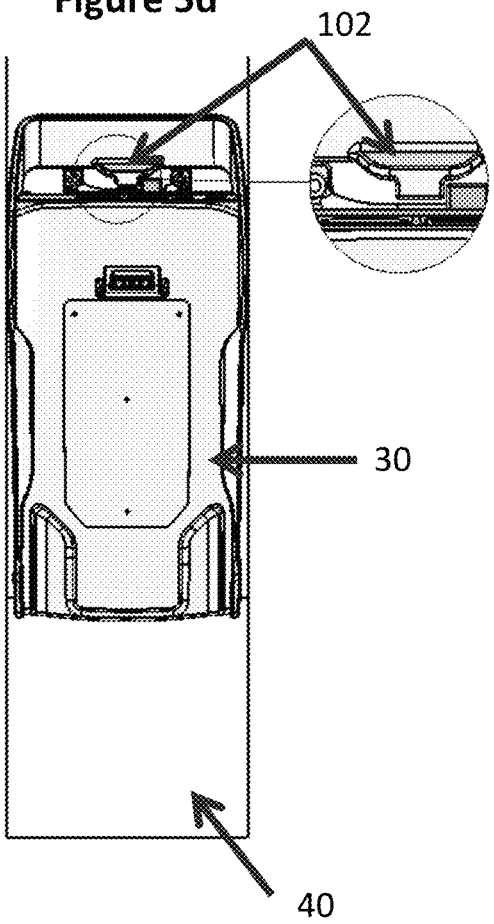

Other features and advantages shall appear more clearly from the following description of one particular embodiment of the disclosure, given by way of a simple, illustratory and non-exhaustive example, and from the appended drawings of which:

FIGS. 1*a* and 1*b* respectively illustrate a support element and a hatch of a conversion system according to one embodiment of the invention;

FIG. 1*c* illustrates an example of a support element of a conversion system according to one embodiment of the invention;

FIGS. 2*a* and 2*b* illustrate an example of a hatch of a conversion system according to one embodiment of the invention, respectively above an electronic payment terminal and affixed to an electronic payment terminal;

FIGS. 2*c* and 2*d* respectively illustrate the non-locked and locked positions of a hatch of a conversion system on a support element of a conversion system according to one embodiment of the invention;

FIG. 3*a* presents an example of a support element of a conversion system according to one embodiment of the invention, to be affixed to a charging base of an electronic payment terminal;

FIG. 3*b* illustrates a support element of a conversion system according to one embodiment of the invention, affixed to a charging base, and an electronic payment terminal ready to be positioned on the charging base;

FIG. 3*c* illustrates an electronic payment terminal being charged on a charging base via a support element of a conversion system according to one embodiment of the invention;

FIGS. 4*a* and 4*b* present an example of a support element of a conversion system according to one embodiment of the invention, respectively ready to be affixed to a pedestal and already fixed to a pedestal;

FIGS. 4*c* and 4*d* illustrate an electronic payment terminal respectively ready to be affixed to a pedestal to which a support element of a conversion system is affixed according to one embodiment of the invention, and already fixed to such a pedestal;

FIGS. 4*e* and 4*f* respectively illustrate the non-locked and locked positions of the first reversible locking means of a support element of a conversion system, according to one embodiment of the invention;

FIGS. 5*a* and 5*b* respectively illustrate a charging base ready to be affixed to a pedestal to which there is affixed a support element of a conversion system according to one embodiment of the invention and an electronic payment terminal positioned on such a charging base;

FIGS. 5*c* and 5*d* respectively illustrate the non-locked and locked positions of a charging base on a support element of a conversion system, according to one embodiment of the invention.

In all the figures of the present document, identical elements and steps are designated by one and the same reference.

5. DESCRIPTION a. General Principle

The general principle of the technique described consists in providing a conversion system, also called a conversion kit, enabling a user (for example a merchant) to reversibly convert a mobile/portable electronic payment terminal into a fixed electronic payment terminal.

Thus, the solution of the invention, according to its different embodiments, offers the user of electronic payment terminals the possibility of converting a mobile electronic payment terminal, all on his own, into a fixed electronic payment terminal without being obliged to send his mobile electronic payment terminal to the manufacturer to carry out the conversion, or even to purchase a fixed electronic payment terminal in addition to his mobile electronic payment terminal. The solution of the invention also enables the user to return to a mobile electronic payment terminal if he so wishes through the reversible characteristic of the conversion.

To this end, the conversion kit according to the invention comprises at least three elements, including two copies of a support element 10 and one hatch 11 illustrated for example in FIGS. 1*a* and 1*b*.

Indeed, to convert a mobile electronic payment terminal into a fixed electronic payment terminal, means for fixedly attaching the mobile electronic payment terminal to a fixed pedestal are needed. In addition, since an electronic payment terminal has to be charged through a charging base, it is also necessary to be able to fixedly attach such a base to a fixed pedestal and to be able to fixedly attach the electronic payment terminal to the charging base.

This is why the conversion kit according to the invention provides two support elements making it possible to fixedly attach the electronic payment terminal to a fixed pedestal or to a charging base as well as a modified electronic payment terminal lower hatch enabling the electronic payment terminal to be adapted to one of the above-mentioned support elements.

b. Support Element(s)

FIG. 1*a* illustrates such an example of a support element 10, having especially first lateral hooking means 101, for example in the form of two lateral hooks, intended to cooperate with corresponding means beneath the electronic payment terminal (via the hatch 11 as described in greater detail here below) or beneath the charging base (as also described in greater detail here below). These hooks therefore serve to hook the electronic payment terminal or the charging base to the support element so as to position it accurately for optimal functioning.

Besides, in order to ensure a fixed attachment of the electronic payment terminal or of the charging base to the support element 10, this support element also has first reversible locking means 102, for example in the form of a mobile central hook intended to cooperate with corresponding means beneath the electronic payment terminal (via the hatch 11 as described in greater detail here below) or beneath the charging base (as also described in greater detail here below). This mobile central hook therefore enables the locking of the electronic payment terminal or the charging base to the support element so as to make the electronic payment terminal fixed. In addition, because of its reversible character, for example through its mobility in the corresponding locking means of the electronic payment terminal or of the base, the central hook can be unlocked and thus makes it possible to detach the electronic payment terminal or the base for mobile use for example. By contrast, in order to ensure efficient and secured fixed attachment, the access 1020 to these reversible locking means (for example the mobile central hook as illustrated in FIG. 1*a*) can for example be planned via a tool. Thus, a mishandling of the electronic payment terminal or of the support element cannot lead to an undesired unlocking.

Such a support element 10 is also illustrated in greater detail in FIG. 1*c*, with especially the different distinct parts (1001, 1002 and 1004) that compose it, as well as the means (104) for affixation to a fixed pedestal (for example a metallic or wooden support, such as a table or a counter) and means (103) of affixation to a charging base (made of plastic).

For example, a support element 10 therefore comprises:

- at least one first part 1001 to receive a charging base or the lower hatch of the electronic payment terminal, this part comprising therefore the first hooking means 101 (for example two lateral hooks);

a second part 1002, smaller in this example, that gets inserted beneath the first part 1001 and comprises first reversible locking means 102 (for example the mobile central hook);

a third part 1004, that gets assembled beneath the first part 1002 (this part is therefore held between the upper part 1001 and the lower part 1004) and is intended to be affixed to a fixed pedestal or to a charging base.

Besides, first affixation means 103 corresponding for example to screws and corresponding apertures intended for the passage of these screws through the support element 10 enable for example affixation to a charging base and second affixation means 104, corresponding for example to screws and corresponding apertures intended for the passage of these screws through the support element 10, enable for example affixation to a fixed pedestal. These means 103 and 104 can be distinct depending on their use for affixation to a base or a fixed pedestal, the screws of the means 103 being for example intended for an affixation to plastic elements while the screws of the means 104 are rather intended for affixation in a metal or wooden support (for example a table).

It is understood that any other technique enabling such affixation can also be implemented.

c. Lower Hatch of the Electronic Payment Terminal

We shall now provide a more detailed description, with reference to FIGS. 1*b* and 2*a* to 2*d*, of a lower hatch 11 of an electronic payment terminal, modified according to the invention to enable cooperation with a support element as described here above.

FIG. 2*a* illustrates a lower hatch 11 of this kind positioned above an electronic payment terminal 20 in order to be affixed thereto (FIG. 2*b*).

As already indicated here above, the lower hatch of the electronic payment terminal must be modified so that it is possible to make the electronic payment terminal a fixed terminal in adapting to a support element. This is why the conversion kit according to the invention provides a lower hatch 11 of an electronic payment terminal that is intended to replace the existing hatch of the mobile electronic payment terminal in the user's possession. It must be noted that this replacement is an easy step to perform for a user inasmuch as the step is approached in a known way, for example as in the case of changing the battery of the electronic payment terminal. This change of lower hatch of an electronic payment terminal therefore requires no particular tool in addition to those already known and used by the user.

As illustrated in FIG. 1*b*, the lower hatch 11 has especially second hooking means 111 (for example in the form of two lateral apertures) to cooperate with the first hooking means 101 of the support elements 10 provided in the conversion kit. Thus, according to the example already described with reference to FIGS. 1*a* and 1*c*, the two lateral hooks 101 of the support element 10 can be inserted into the two lateral apertures 111 of the lower hatch 11 so as to accurately position the electronic payment terminal 20 on the support element 10. Then, in order to lock the electronic payment terminal to the support element 10, the lower hatch 11 has second reversible locking means 112 (for example in the form of a central aperture) to cooperate with the first reversible locking means of the support element. For example, the central aperture 112 makes it possible firstly to insert the mobile central hook 102 of the support element 10 as well as its movement to pass from a non-locked position of installation to a locked position as illustrated for example respectively in FIGS. 2*c* and 2*d*.

It is understood that any other technique enabling such hooking can also be implemented.

In addition, the lower hatch 11 can be fixedly attached (in a known way) beneath the electronic payment terminal by means of fixed attachment means 113*a* and 113*b*, for example in the form of hooks as illustrated in FIGS. 2*a* and 2*b*.

FIGS. 2*c* and 2*d* for their part illustrate the positions in which the lower hatch 11 is non-locked (FIG. 2*c*) and locked (FIG. 2*d*) to a support element 10 via the cooperation of the first and second reversible locking means 102 (of the support element) and 112 (of the hatch). Indeed, it can be seen that the central hook 102 of the support element 10 has passed from a right-hand position (non-locked) in the corresponding aperture 112 of the hatch 11 (illustrated in FIG. 2*c*) to a left-hand position (locked) in the corresponding aperture 112 of the hatch 11 (illustrated in FIG. 2*d*). It is also seen besides that the lateral hooks 101 of the support element 10 are inserted into the corresponding lateral apertures 111 of the hatch 11.

d. Electronic Payment Terminal on a Charging Base

As already indicated here above, one of the possible uses for the mobile electronic payment terminal converted into a fixed electronic payment terminal according to the invention corresponds to the one where the electronic payment terminal 20 is placed on a charging base 30 via a support element 10 provided in the conversion kit. This configuration is illustrated especially by FIGS. 3*a* to 3*c*.

In addition, as described here below with reference to FIGS. 5*a* to 5*c*, the charging base 30 can itself be also fixed to a fixed pedestal.

Thus, FIG. 3*a* presents a charging base 30 on which a support element 10 given in the conversion kit according to the invention can be affixed, especially via the affixation means 103 of the support element 10. In particular, as already indicated here above, the charging base 30 is adapted to receiving this support element 10 and especially to enabling the affixation of this support element 10. For example, receiving means (not shown) for receiving the screws 103 provided with the support element are planned in the charging base 30.

Once the support element 10 is fixed to the charging base 30, it is then possible to position (FIG. 3*b*) the electronic payment terminal 20, with its lower hatch 11 modified as described here above, on the charging base 30 in order to charge the electronic payment terminal 20. The first hooking means 101 (for example the two lateral hooks) of the support element 10 affixed to the charging base 30 can then get inserted into the second hooking means 111 (for example the two lateral apertures) provided in the modified lower hatch 11 of the electronic payment terminal 20. Similarly, the first reversible locking means 102 (for example the mobile central hook) of the support element 10 affixed to the charging base 30 can then get inserted into the second reversible locking means 112 (for example the central aperture) provided in the modified lower hatch 11. FIG. 3*c* illustrates this configuration.

Finally, in order to lock the electronic payment terminal 20 to the charging base 30, these first reversible locking means 102 can be actuated in the second reversible locking means 112 (for example via the introduction of a tool by lateral access to the support element) as already described here above.

e. Electronic Payment Terminal on a Fixed Pedestal

As already indicated here above, another possible use for the mobile electronic payment terminal converted into a fixed electronic payment terminal according to the invention corresponds to the one where the electronic payment terminal 20 is directly affixed to a fixed pedestal 40 via a support element 10 provided in the conversion kit. This configuration is illustrated especially in FIGS. 4*a* to 4*f*.

Thus, FIGS. 4*a* and 4*b* present a fixed pedestal 40 (for example a pedestal affixed to a merchant's counter) on which a support element 10, provided in the conversion kit according to the invention, can be affixed, especially through affixation means 104 for affixing the support element 10 (already described with reference to FIG. 1*c*).

FIGS. 4*c* and 4*d* then present the configuration of use of the electronic payment terminal 20 in which it is positioned on this fixed pedestal 40, via the support element 10 cooperating with the lower hatch 11 provided in the conversion kit.

As in the case of the configuration described here above, the first hooking means 101 (for example the two lateral hooks) of the support element 10 affixed to the fixed pedestal 40 can then get inserted into the hooking means 111 (for example the two lateral apertures) provided in the modified lower hatch 11 of the electronic payment terminal 20. Similarly, the first reversible locking means 102 (for example the mobile central hook) of the support element 10 affixed to the fixed pedestal 40 can then get inserted into the second reversible locking means 112 (for example the central aperture) provided in the modified lower hatch 11 of the electronic payment terminal 20. FIG. 4*d* illustrates this configuration.

Finally, to lock the electronic payment terminal 20 to the fixed pedestal 40, these first reversible locking means 102 can be actuated in the second reversible locking means 112 (for example by the introduction of a tool through a lateral access on the support element) as already described here above. Thus, FIGS. 4*e* and 4*f* therefore illustrate the non-locked and locked positions respectively of the first reversible locking means 102 of a support element 10. Indeed, it is seen that the central hook 102 of the support element 10 has passed from a right-hand position (not locked) to a left-hand position (locked).

f. Electronic Payment Terminal on a Fixed Pedestal Via a Charging Base

Referring now to FIGS. 5*a* to 5*c*, we describe the configuration in which the electronic payment terminal converted into a fixed electronic payment terminal is placed on a charging base 30 via a first support element 10 provided in the conversion kit, the charging base 30 itself being also affixed to a fixed pedestal 40 via a second support element 10.

In this configuration, a first support element 10*a* is affixed to a charging base 30, as in the configuration described in paragraph d. here above and a second support element 10*b* is affixed to the fixed pedestal 40, as in the configuration described in paragraph e. here above.

As illustrated in FIG. 5*a*, a charging base 30 (illustrated in this FIG. 5*a* without the first support element 10*a*) is positioned so as to get affixed to the second support element 10*b* affixed to the fixed pedestal 40, then as illustrated in FIG. 5*b*, the electronic payment terminal 20, with a lower hatch 11 given in the conversion kit, is affixed to the charging base 30.

This configuration therefore uses all the elements provided (the two support elements and the hatch) in the conversion kit and makes sure that the electronic payment terminal 20 is made fixed when the electronic payment terminal 20 is locked to the first support 10*a* and, at the same time, the charging base 30 is locked to the second support 10*b* as illustrated in FIGS. 5*c* and 5*d*. Indeed, in these figures, the non-locked position (FIG. 5*c*) and locked position (FIG. 5*d*) of the first reversible locking means 102 of a support element 10 are represented, the central hook 102 of the support element 10 passing from a central (non-locked) position in the corresponding aperture beneath the charging base 30 to a right-hand (locked) position in the corresponding aperture beneath the charging base 30.

The conversion kit/system according to the different embodiments of the invention therefore resolves the technical problem in providing all the means enabling a user to modify his mobile electronic payment terminal, on his own, into a fixed electronic payment terminal without having recourse to the manufacturer of the electronic payment terminal or resorting to the purchase of another electronic payment terminal.

The invention claimed is:

1. A system of conversion of a mobile electronic payment terminal into a fixed electronic payment terminal, said system of conversion comprising at least the following elements:

first and second support elements, each comprising first hooking elements and a first reversible locking element, said first and second support elements being configured to receive said electronic payment terminal or a charging base for charging said electronic payment terminal and to be fixedly attached to said charging base or to a fixed pedestal wherein:

the first support element corresponds to a base support element, configured to be fixedly attached to said charging base of said electronic payment terminal and to receive said electronic payment terminal;

the second support element corresponds to a pedestal support element configured to be fixedly attached to said fixed pedestal and to receive said electronic payment terminal or said charging base of said electronic payment terminal; and a lower hatch configured to be fixed beneath said electronic payment terminal and comprising second hooking elements configured to cooperate with said first hooking elements of the first or second support elements, and a second reversible locking element configured to cooperate with said first reversible locking element of the first or second support elements.

2. The system of conversion according to claim 1, wherein said first hooking elements correspond to at least two fixed lateral hooks and said first reversible locking element corresponds to at least one mobile central hook, called a locking hook, and wherein said second hooking elements of said hatch correspond to at least two lateral apertures cooperating with said two fixed lateral hooks and said second reversible locking element corresponds to at least one central aperture cooperating with said locking hook.

3. The system of conversion according to claim 1, wherein said first and second support elements each furthermore have first affixation elements to affix to said charging base and second affixation elements to affix to said fixed pedestal.

4. The system of conversion according to claim 1 wherein at least one of the first and second support elements comprises at least one first part to receive said charging base or said hatch of said electronic payment terminal, a second part comprising said first reversible locking element and a third part to be fixed to said fixed pedestal or to said charging base.

5. The system of conversion according to claim 1, wherein said hatch comprises a part adapted to the lower surface of said electronic payment terminal and two mobile parts for fixedly attaching said hatch to said electronic payment terminal.

6. A system of conversion of a mobile electronic payment terminal into a fixed electronic payment terminal, said system of conversion comprising at least the following elements:

first and second support elements, each comprising first hooking elements and a first reversible locking element, said first and second support elements being configured to receive said electronic payment terminal or a charging base for charging said electronic payment terminal and to be fixedly attached to said charging base or to a fixed pedestal; and a lower hatch configured to be fixed beneath said electronic payment terminal and comprising second hooking elements configured to cooperate with said first hooking elements of the first or second support elements, and a second reversible locking element configured to cooperate with said first reversible locking element of the first or second support elements, wherein said first hooking elements correspond to at least two fixed lateral hooks and said first reversible locking element corresponds to at least one mobile central hook, called a locking hook, and wherein said second hooking elements of said hatch correspond to at least two lateral apertures cooperating with said two fixed lateral hooks and said second reversible locking element corresponds to at least one central aperture cooperating with said locking hook.

7. A system of conversion of a mobile electronic payment terminal into a fixed electronic payment terminal, said system of conversion comprising at least the following elements:

first and second support elements, each comprising first hooking elements and a first reversible locking element, said first and second support elements being configured to receive said electronic payment terminal or a charging base for charging said electronic payment terminal and to be fixedly attached to said charging base or to a fixed pedestal; and a lower hatch configured to be fixed beneath said electronic payment terminal and comprising second hooking elements configured to cooperate with said first hooking elements of the first or second support elements, and a second reversible locking element configured to cooperate with said first reversible locking element of the first or second support elements, wherein at least one of the first and second support elements comprises at least one first part to receive said charging base or said hatch of said electronic payment terminal, a second part comprising said first reversible locking element and a third part to be fixed to said fixed pedestal or to said charging base.

* * * * *